United States Patent [19]

Phillips

[11] Patent Number: 4,759,383

[45] Date of Patent: Jul. 26, 1988

[54] TOOTHBRUSH STERILIZING DEVICE

[76] Inventor: Lucille Phillips, 12217 Iredell St., Studio City, Calif. 91601

[21] Appl. No.: 17,323

[22] Filed: Feb. 20, 1987

[51] Int. Cl.[4] ..... B08B 3/04

[52] U.S. Cl. ..... 134/93; 134/104; 134/135; 134/200; 134/201; 206/361; 15/38; 15/104 R; 422/292; 422/297; 422/301

[58] Field of Search ..... 134/6, 93, 104, 135, 134/182, 200, 201; 15/38, 104 R; 422/292, 297, 300, 301; 206/0.5, 361, 83, 63.5

[56] References Cited

U.S. PATENT DOCUMENTS

| | | | |
|---|---|---|---|
| 1,419,593 | 6/1922 | Thompson | 422/300 X |
| 1,566,860 | 12/1965 | Hainzigianis | 422/300 X |
| 2,366,369 | 1/1945 | Tannenberg | 422/300 X |
| 3,169,539 | 2/1965 | Van Der Feer | 134/155 X |
| 3,342,544 | 9/1967 | Curiel | 422/300 |
| 3,881,868 | 5/1975 | Duke | 206/63.5 |
| 4,211,750 | 7/1980 | Gillespie | 422/300 X |

FOREIGN PATENT DOCUMENTS

| | | | |
|---|---|---|---|
| 460687 | 7/1912 | France | 422/300 |
| 592363 | 8/1925 | France | 422/300 |

*Primary Examiner*—Harvey C. Hornsby
*Assistant Examiner*—Frankie L. Stinson
*Attorney, Agent, or Firm*—Edward D. O'Brian

[57] ABSTRACT

An elongated housing having its interior divided into a top and a bottom compartment by a perforate dividing wall can be used as a device to sterilize toothbrushes. When it is used for this purpose the top compartment is filled with water and the brush end of a toothbrush and a sterilizing composition are both introduced into the top compartment on the dividing wall as the water is allowed to drain into the bottom compartment past the brush end of the toothbrush.

6 Claims, 1 Drawing Sheet

22
20
24
12
52
10
46
16
48
14
18
50
44
28
2
40
42
38
3
34
36
32
30
26
54

TOOTHBRUSH STERILIZING DEVICE

BACKGROUND OF THE INVENTION

The invention described in this specification primarily pertains to new and improved toothbrush sterilizing devices.

It is often recognized that small particles of food or the like and bacteria will remain on a toothbrush after the brush is used. Although the vast majority of such contaminants are normally removed from a tooth brush by rinsing, it is highly probable that not all contaminants will be removed from a toothbrush in this manner. As a consequence of this, there is a reasonable likelihood that some contamination will remain on a toothbrush after it has been used and rinsed in a conventional manner. Of course any such remaining contaminating material will be inserted into the mouth when the brush is used again.

It is easy to see how this could result in harmful or potentially harmful bacteria being introduced back into the mouth. Further, the conventional manner of using and reusing a toothbrush has the potential of introducing greater quantities of bacteria into the mouth than survived the usual rinsing of the brush as result of such bacteria growing on the vestiges of food particles remaining on the brush after rinsing during the interim between uses of the brush. As science becomes increasingly aware of the importance of sanitation or hygience, it is being increasingly recognized that any procedure which has the potential of introducing possibly harmful bacteria into the human system is undesirable.

Obviously there are many known sterilizing methods which could be used to make sure that contaminants are not tansferred into a mouth on a previously used toothbrush. Various conventional techniques such as autoclaving, exposing to sterilizing gases and using appropriate radiation tending to kill bacteria are all capable of being used in sterilizing toothbrushes prior to their being reused. The use of such techniques of this purpose is considered to be undesirable in the usual domestic residence because of any one of a variety of reasons. In general such techniques are not simply not practical for use with a single toothbrush.

It is also possible to use known sterilizing solutions for the purpose of disinfecting toothbrushes between uses. This type of procedure has the disadvantage that it normally requires the maintenance for a glass or similar container of the disinfectant in a location adjacent to where a toothbrush is used. This is occasionally undesirable because of the possibility of a child consuming the disinfectant. Also a glass of a liquid containing one or more toothbrushes can tend to be somewhat unsightly. It is considered more important that the prolonged immersion of at least the brush or head end of a toothbrush in a container of a disinfectant can be detrimental to the brush.

BRIEF SUMMARY OF THE INVENTION

As a result of these considerations it is considered that it will be apparent that there is a need of a new and improved manner of disinfecting a toothbrush which is particularly adapted to be used in a residence or the like. Broadly the present invention is intended to remedy this need. More specifically it is intended to do this by providing new and improved tooth brush sterilizing devices and a novel process of sterilizing a tooth brush as is used with these devices.

The invention is intended to provide sterilizing devices as discussed herein which are desirable because they can be easily and conveniently used in practicing the noted process and because they may be easily and conveniently manufactured at a nominal cost. These sterilizing devices are desirable because they be easily and conveniently used without detrimentally affecting a tooth brush to any noticeable extent. Further, these sterilizing devices are economically desirable because they may be used as the primary part of a composite package for use in selling or conveying a tooth brush.

In accordance with this invention these objectives are achieved by providing a toothbrush sterilizing device which includes: an elongated generally tubular housing having an upper end and a lower end, dividing wall means for allowing a sterilizing fluid located within said housing above said dividing wall means to slowly flow downwardly past said dividing wall means and for supporting the brush end of a toothbrush so that said brush end is contacted by sterilizing fluid flowing past said dividing wall means, said upper end being open so as to be capable of having a liquid located therein.

DETAILED DESCRIPTION

Because of the nature of this invention it is best more fully explained with reference to the accompanying drawing in which.

Figures 1, 2, 3, 4:
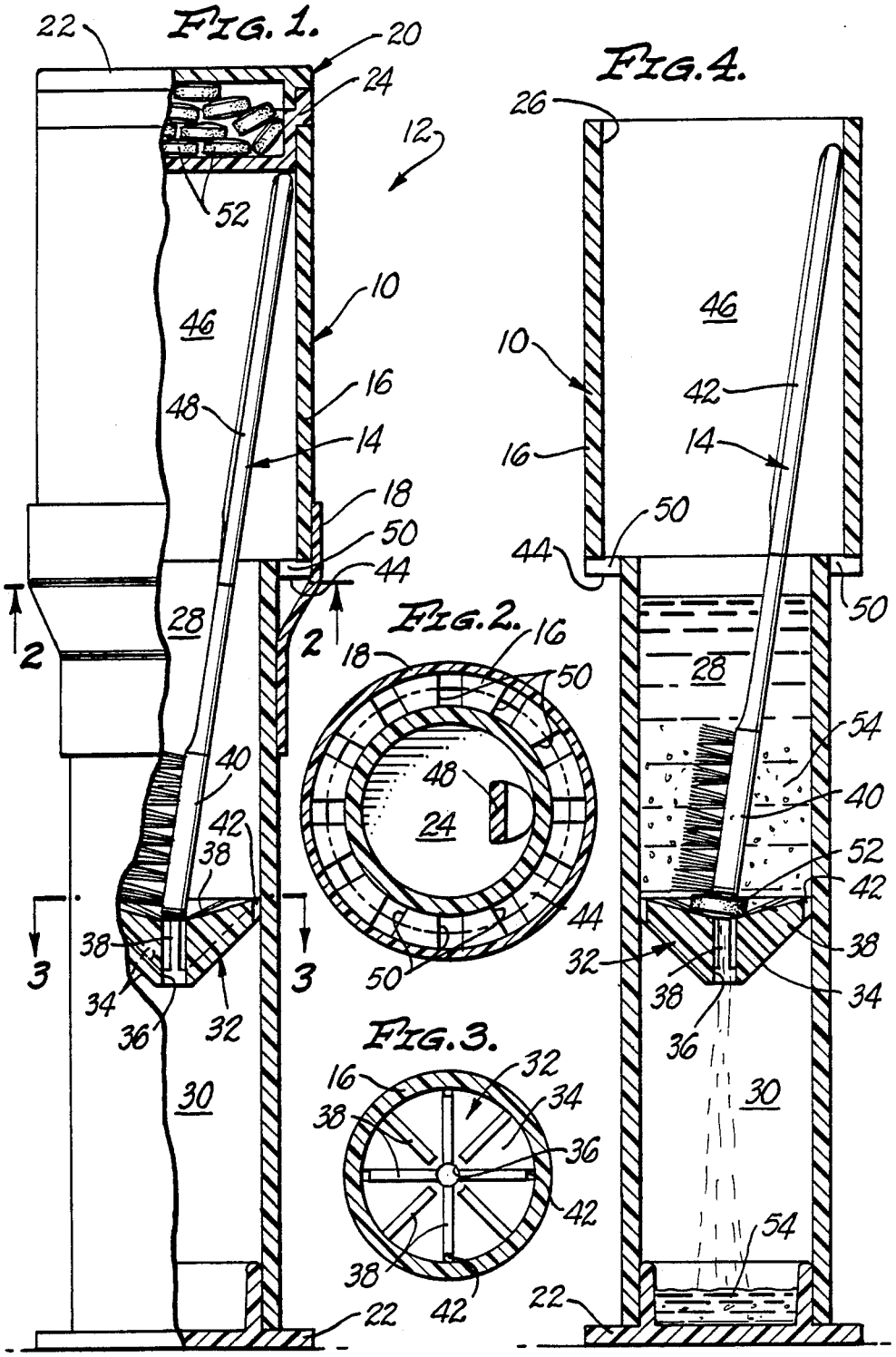
FIG. 1 is a side elevational view of a presently preferred embodiment or form of a toothbrush sterilizing device of this invention as it is preferably employed with "auxiliary" parts or items as a package for a toothbrush, this view being partially in section.
FIG. 2 is a cross sectional view of the sterilizing device shown in FIG. 1, this view being taken at line 2—2 of FIG. 1.
FIG. 3 is a cross-sectional view taken at line FIG. 3—3 of FIG. 2.
FIG. 4 is a longitudinal sectional view taken at the vertical center line of FIG. 1 showing the sterilizing device in use.

It is to be understood that a number of differently appearing and differently constructed toothbrush sterilizing devices can be made in accordance with the concepts of the invention set forth and summarized in the appended claims through the use of routine engineering skill on the basis of the disclosure embodied within this specification and the accompanying drawing. For this reason the invention is to be limited only by the claims.

It is to be also understood that the title "Toothbrush Sterilizing Device" as used in this specification is not to be considered as limiting this invention to devices which can only be employed in sterilizing toothbrushes. This title has been chosen since it is considered that the principal utility of the invention will be in sterilizing toothbrushes. However, it is considered self-evident that a device as described in this document can be used in sterilizing of otherwise treating a variety of different types of brushes used for various different purposes.

DETAILED DESCRIPTION OF THE PREFERRED EMBODIMENT

In the drawing there is shown a toothbrush sterilizing device 10 in accordance with this invention which, as shown in FIG. 1, may be used as an integral part of a package 12 for a toothbrush 14. This package 12 includes a housing 16, a sealing band 18 and a top closure member 20. The sealing band 18 is preferably formed of a conventional, easily severed, imperious material such as a known type of heat shrinkable polymer. Although this closure member 20 can merely be a conventional top lid 22, it is preferably a combination of a small container 24 and the top lid 22 as shown and as subsequently described. A bottom lid 22, corresponding to the top lid 22 is also preferably used.

The principal part of the sterilizing device 10 is an elongated generally tubular housing 16 of an inert or substantially inert material. It is considered immaterial if this housing 16 is of a cylindrical or a rectangular character but it is considered important that it be formed of a material such as many common thermoplastic polymers which can be used with common sterilizing compositions without being chemically attacked to any noticeable extent. It is also important that the housing 16 has a normally open top end 26 of such a dimension that the toothbrush 12 can be easily inserted within it and of such dimension that this end 26 can be closed with either the complete closure member 20 or the lid 22.

The interior (not separately numbered) of the housing 16 is preferably separated into a top compartment 28 and a bottom compartment 30 through the use of a dividing wall means 32. This wall means 32 includes a sloping bottom wall 34 attached to the housing 16 which leads downwardly in a conical fashion to a restricted bottom opening 36. If desired more than one opening 36 can be used. A series of vertically extending vanes 38 are preferably located on the bottom wall 34 in such a position as to be capable of supporting the "head" or bristle containing end 40 of the toothbrush 14.

At least one vent opening or vent 42 is provided in the bottom wall 34 adjacent to the housing 16 and adjacent to the top (not separately numbered) of the wall 34 so as to avoid air being trapped in the compartmnet 30 as the device 10 is used. If desired, this vent opening 42 could extend directly through the housing 16 instead of extending through the wall 34 as shown. When the device 10 is used as a part of the package 12 as indicated in FIG. 1 it is preferred to have this vent opening 42 extend through the wall 34 so avoid any concern about it being sealed off from the ambient in order to prevent contamination within the interior of the package 12.

The housing 16 also is preferably provided with a peripheral shoulder 44 separating the top compartment 28 from an extension 46 of it which is necessary to accommodate the handle 48 of the toothbrush 12 when the device 10 is used as a part of the package 12. This shoulder 44 is interrupted by a series of peripheral openings 50 leading through the housing 16. This shoulder 44 and the openings 50 are located so that the volume of the compartment 28 will be no greater than the volume of the compartment 30. The openings 42 are used because the volume of the compartment 28 needed for the device to function as indicated will normally be somewhat less than the volume needed of the device 10 to be useful as a package. These openings 42 are employed so as to discharge any water in excess of that needed to fill the compartment 28 as rapidly as possible after water has been placed within the top end 26 of the housing 16. For this purpose it is necessary for the total area of all of the apertures or openings 50 to be comparatively large. When the device 10 is used as a package 12 these openings 50 are sealed off by the band 18.

During the use of the device 10 the top end 26 of the device 10 is filled with water until the water starts coming out the openings 50. As soon as flow through the openings 50 ceases a tablet 52 (such as one of the tablets 52 shown in FIG. 1) of a composition which will rapidly dissolve in water to form a sterilizing solution, preferably an effervescent sterilizing solution, 54 is introduced into the compartment 28. Each table 52 used should be larger than any opening 36 so that it will be held within the top compartment 28. This should be done as promptly as possible after the flow though the openings 50 has stopped before an appreciable amount of water has run out of this compartment 28 through the opening 36 (or openings 36). Then as promptly as possible a toothbrush such as the toothbrush 12 will be introduced into the compartment 28 as shown.

At this point the sterilizing solution 54 formed as a result of a tablet 52 going into solution will gradually drain out through the opening 36 (or openigns 36). Concurrently the end 40 of the toothbrush 12 will be constantly contacted with "fresh" sterilizing solution 54 and the solution will flow past the end 40 tending to rinse any accumulations or other particles off of this end 40 as it is sterilized by contact with soution 54. Preferably the volume of the compartment 28 and the cross-sectional area of the opening 36 (or openings 36) are related so that this end 40 is immersed in the flowing solution 54 at least long enough so that the end 40 will be effectively cleaned and sterilized.

If the housing 16 is located within a wash basin, a sink or the like (not shown) as this series of steps is carried out the spent solution 54 will of course flow from the device 10 into the drain normally associated with such a receptacle. If this is not desirable or practical the bottom lid 22 may be used to retain the spent solution 54 within the bottom compartment 30 until it is convenient to empty this spent solution by removing the lid 22. In either event after the solution 54 has flowed past the head 40 of the brush 14 this head will tend to dry. By virtue of the fact that the head 40 will have been in contact with the solution for only a limited period it will not normally be detrimentally affected by the solution 54.

If desired it is possible to omit the use of a table 52 and to substitute for such a tablet a sterilizing powder composition (not shown) which will serve the same function as the composition within the tablets 52. Such a powder composition can be stored in the same manner as the tablets 52 in the container 24. Normally such a powder composition will be employed by dipping a damp toothbrush in it immediately after the brush has been used and then immediately moving the brush to within the housing 16 after the compartment 28 has been filled with water as described. In the usual circumstance the dampness of the brush 14 will be adequate to cause an amount of the power which is effective to sterilize it to adhere to the brush as the brush as is introduced into the housing 16.

I claim:

1. A toothbrush sterilizing device which includes:

an elongated generally tubular housing having an upper end and a lower end dividing wall means for allowing a sterilizing fluid located within said housing above said dividing wall means to slowly flow downwardly past said dividing wall means and for supporting the brush end of a toothbrush so that said brush end is contacted by sterilizing fluid flowing past said dividing wall means, said wall means dividing said housing into a top compartment located above said wall means and a bottom compartment located below said wall means, said upper end being open so as to be capable of having a liquid located therein, said dividing wall means comprises a sloping bottom wall, said bottom wall having one or more bottom openings leading through there so as casrry sterilizing fluid flowing from said top compartment to said bottom compartment, said dividing wall means also including vent means for preventing air from being trapped in said bottom compartment, said vent means in located in said sloping wall adjacent to the top thereof and leads between said top and said bottom compartments.

2. A toothbrush sterilizing device as claimed in claim 1 wherein:

said wall means includes a series of vertically extending vanes located thereon, said vanes being capable of supporting the head of a tooth brush, said housing includes an extension extending upwardly from said top compartment, said extension being separated from said top compartment by a plurality of holes for conveying water from the inside of said extension to the exterior of said housing.

3. A toothbrush sterilizing device as claimed in claim 2 including:

a lid means closing said upper end of said housing and another lid means closing said lower end of said housing, band means extending around the periphery of said container and sealing off said holes in said housing located between said extension and said top compartment, both of said lid means and said band means closing off the interior of said housing so that said sterilizing device can be used as a package for a toothbrush.

4. A toothbrush sterilizing device as claimed in claim 3 including:

a container for holding a sterilizing material located on said housing between said lid means for closing the upper end of said housing and said upper end of said housing.

5. A toothbrush sterilizing device which includes:

an elongated generally tubular housing having an upper end and a lower end dividing wall means for allowing a sterilizing fluid located within said housing above said dividing wall means to slowly flow downwardly past said dividing wall means and for supporting the brush end of a toothbrush so that said brush end is contacted by sterilizing fluid flowing past said dividing wall means, said wall means dividing said housing into a top compartment located above said wall means and a bottom compartment located below said wall means, said upper end being open so as to be capable of having a liquid located therein, a lid means closing said upper end of said housing and another lid means closing said lower end of said housing.

band means extending around the periphery of said container and sealing off said holes in said housing located between said extension and said top compartment, both of said lid means and said band means closing off the interior of said housing so that said sterilizing device can be used as a package for a toothbrush.

6. A toothbrush sterilizing device as claimed in claim 5 including:

a container for holding a sterilizing material located on said housing between said lid means for closing the upper end of said housing and said upper end of said housing.

* * * * *